US007773929B2

(12) United States Patent
Kitami et al.

(10) Patent No.: US 7,773,929 B2
(45) Date of Patent: Aug. 10, 2010

(54) FUSING DEVICE WITH SUPPLEMENTAL HEATING MEMBER AND IMAGE FORMING APPARATUS

(75) Inventors: Kenji Kitami, Kashihara (JP); Toshiya Mikita, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 553 days.

(21) Appl. No.: 11/635,007

(22) Filed: Dec. 7, 2006

(65) Prior Publication Data

US 2007/0134034 A1 Jun. 14, 2007

(30) Foreign Application Priority Data

Dec. 14, 2005 (JP) ..... 2005-360324

(51) Int. Cl.
*G03G 15/20* (2006.01)

(52) U.S. Cl. ..... 399/328

(58) Field of Classification Search ..... 399/328, 399/330

See application file for complete search history.

(56) References Cited

U.S. PATENT DOCUMENTS 4,618,240 A * 10/1986 Sakurai et al. ..... 399/334
6,289,185 B1 * 9/2001 Cahill ..... 399/334
7,107,001 B2 * 9/2006 Kameda ..... 399/328
2007/0000899 A1 * 1/2007 Tsunoda ..... 219/216

FOREIGN PATENT DOCUMENTS

| | | |
|---|---|---|
| JP | S58-070265 | 4/1983 |
| JP | 10-149044 | 6/1998 |
| JP | 2001-343860 | 12/2001 |
| JP | 2005-257746 | 12/2001 |
| JP | 2003-45638 | 2/2003 |
| JP | 2003-295658 | 10/2003 |
| JP | 2005-003028 | 1/2005 |
| JP | 2005-221712 | 8/2005 |
| JP | 2005-234027 | 9/2005 |

* cited by examiner

*Primary Examiner*—David M Gray
*Assistant Examiner*—Ruth N Labombard
(74) *Attorney, Agent, or Firm*—Nixon & Vanderhye, PC

(57) ABSTRACT

A fusing device includes a pressure member, a heating member, and an external heating member. The heating member has an outer surface in contact with an outer surface of the pressure member. The heating member heats a sheet that is being passed in a first direction through a contact area between the pressure member and the heating member. The external heating member heats a predetermined area of the surface of the heating member from outside. Length of the predetermined area along a second direction that is perpendicular to the first direction is set shorter than entire length of the heating member along the second direction.

8 Claims, 4 Drawing Sheets

FUSING DEVICE WITH SUPPLEMENTAL HEATING MEMBER AND IMAGE FORMING APPARATUS

CROSS REFERENCE

This Nonprovisional application claims priority under 35 U.S.C. §119(a) on Patent Application No. 2005-360324 filed in Japan on Dec. 14, 2005, the entire contents of which are hereby incorporated by reference.

BACKGROUND OF THE TECHNOLOGY

The technology relates to a fusing device for fixing a developer image on a sheet. The technology further relates to an electrophotographic image forming apparatus, such as a copier, a printer, or a facsimile machine, provided with such fusing device.

An electrophotographic image forming apparatus transfers a developer image (hereinafter referred to as a toner image) on a sheet, and then fuses and fixes developer (hereinafter referred to as toner) on the sheet with a fusing device. The fusing device includes a heat roller and a pressure roller.

The heat roller has a first internal heater lamp positioned along an axial direction thereof. The first heater lamp heats the heat roller from the inside, and the heat roller in turn heats a sheet being passed between the heat roller and a pressure roller, thereby fusing toner on the sheet.

The pressure roller is supported, with its axis parallel to the axial direction of the heat roller, in contact with an outer surface of the heat roller. The pressure roller pressurizes a sheet being passed between the heat roller and the pressure roller, thereby fixing fused toner onto the sheet. The pressure roller has a second internal heater lamp positioned along an axial direction thereof. The second heater lamp heats the pressure roller from the inside. The pressure roller in turn heats the surface of the heat roller and a sheet being passed between the heat roller and the pressure roller, in a supplemental manner.

Each of the heat and pressure rollers is supported on both axial ends by a frame of the image forming apparatus.

The heater lamp is required to be controlled in such a manner that the heat roller has a uniform surface temperature for uniform transfer of toner on a sheet. Also, image forming apparatus are normally supplied with power through outlets provided in offices or the like, i.e., by a commercial power supply. It is thus essential to develop an image forming apparatus operable at 100V/15 A, which is a common value for commercial power.

Meanwhile, many multifunctional image forming apparatus have been recently developed that are provided with not only a printing device but also optional devices such as an automatic document reader (i.e., a scanner), a postprocessing device (with postprocessing functions such as of stapling or punching), or a Large-Capacity Cassette (LCC).

Commercial power is insufficient for such multifunctional image forming apparatus, resulting in power shortages in some sections of the apparatus. To the sections having power shortages, power originally intended for consumption by a fusing device is diverted. This causes a decrease in power supply to the fusing device, thereby preventing an outer surface of the heat roller from being held at a constant temperature and therefore causing degradation in fusing performance.

In a case where total power supplied by the commercial power supply is 1500 W, for example, power available to the apparatus is approximately 1200 W to 1300 W in view of power fluctuations and safety standards. Of the available power, 200 W to 300 W of power is allocated to activate and control the apparatus itself, and 800 W to 1000 W of power is allocated to heaters in the fusing device. When optional devices such as described above are installed, 200 W to 400 W of power is subtracted from the power allocated to the heaters, to be allocated to activate and control the optional devices.

The temperature of the heat roller is high in the center area and decreases towards each of its axial ends, even when the entire heat roller is uniformly heated. This is because the heat escapes from each axial end to the frame of the image forming apparatus through a rotation shaft and shaft bearings. Thus, the heat roller has a plurality of internal heater lamps each having a heating element, and the heating elements are arranged at different positions along the axis. The arrangement of the heating elements allows a greater amount of heat to be generated at each axial end of the heat roller than in the center area, thereby ensuring that the heat roller maintains a substantially uniform distribution of surface temperature across its axial direction.

Recently, fusing devices have been developed that use an external heat roller as a supplementary heating member for heating an outer surface of a main heat roller quickly. Such fusing devices are disclosed by JP H10-149044A and JP 2005-221712A. The external heat roller is supported with its axis parallel to an axial direction of the main heat roller, and has internal heater lamps arranged along the axis. Generally, the external heat roller is formed so as to be at least equal in axial length to the main heat roller so that the entire surface of the main heat roller is heated.

The heat control as described earlier, however, involves complicated control of maintaining a substantially uniform distribution of surface temperature of the heat roller across its axial direction within a limited amount of available power. This is particularly the case with fusing devices provided with an external heat roller because such devices involve more complicated control of energizing heater lamps provided in main and supplementary heat rollers in an appropriate way.

A feature is to provide a fusing device that enables simplified heating control for maintaining a uniform distribution of surface temperature of a heat roller, and an image forming apparatus provided with such fusing device.

SUMMARY OF THE TECHNOLOGY

A fusing device includes a pressure member, a heating member, and an external heating member. The heating member has an outer surface in contact with an outer surface of the pressure member. The heating member heats a sheet that is being passed in a first direction through a contact area between the pressure member and the heating member. The external heating member heats a predetermined area of the surface of the heating member from outside. Length of the predetermined area along a second direction that is perpendicular to the first direction is set shorter than entire length of the heating member along the second direction.

DETAILED DESCRIPTION OF THE TECHNOLOGY

Described below, with reference to the accompanying drawings, is an image forming apparatus to which a fusing device is applied.

Figure 1:
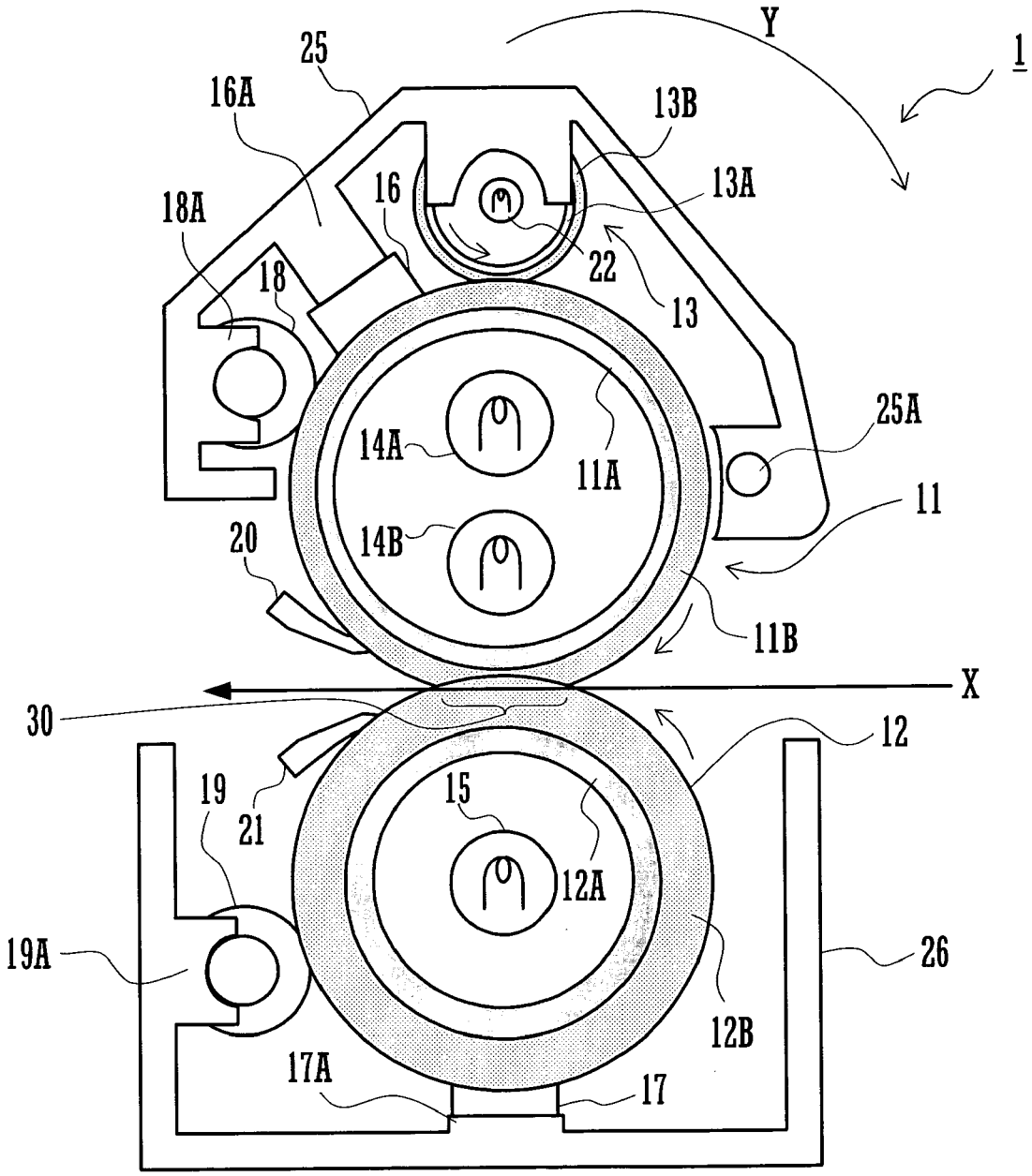
FIG. 1 is a front cross-sectional view illustrating a schematic configuration of a fusing device.

FIG. 1 is a front cross-sectional view illustrating a schematic configuration of a fusing device. An electrophotographic image forming apparatus includes an image forming section (not shown), and forms an image on a sheet based on image data. The image forming section has a not-shown photoreceptor drum (image bearing member) and a fusing device 1. After a toner image formed on the drum is transferred to a sheet, the device 1 fixes the toner on the sheet with heat.

Referring to FIG. 1, the device 1 has a heat roller 11 and a pressure roller 12. The roller 11 is supported rotatably in a direction of arrow as shown in the figure. The roller 11 has internal heater lamps 14A and 14B each in the shape of a rod. The lamps 14A and 14B correspond to the first heater lamp of the Claims. The lamps 14A and 14B are positioned with their lengths parallel to an axial direction of the roller 11. The lamps 14A and 14B heat an entire inner surface of the roller 11. The roller 11 applies heat to a sheet when in contact with the sheet, thereby fusing toner on the sheet.

The roller 11 has a metal core 11A and a surface layer 11B. As an example, the core 11A is formed of iron of 2 to 3 mm thickness, and the layer 11B is formed of high-thermal-conductivity $SiO_2$ rubber of 1.0 mm to 1.5 mm thickness.

The pressure roller 12 has an internal heater lamp 15. With an axis thereof parallel to the axial direction of the roller 11, the roller 12 is supported rotatably in a direction of arrow as shown in the figure. The roller 12 is pressed against an outer surface of the roller 11 at a predetermined pressure. While a sheet is being passed through a contact area (a fixing nip area) 30 between the rollers 11 and 12, the roller 12 presses the sheet against the roller 11 to impregnate cellulosic fibers in the sheet with fused toner. The lamp 15 corresponds to the third heater lamp of the Claims. The lamp 15 is positioned with its length parallel to the axial direction of the roller 12. The lamp 15 heats an entire inner surface of the roller 12. The roller 12 has a metal core 12A and a surface layer 12B. As an example, the core 12A is made of iron of equal to or more than 5 mm thickness, and the layer 12B is formed of $SiO_2$ rubber of 5 to 8 mm thickness.

The device 1 also has an external heat roller 13, thermistors 16 and 17, cleaning members 18 and 19, and sheet separators 20 and 21. The roller 13, the thermistor 16, the member 18, and the separator 20 are arranged along the surface of the roller 11. The thermistor 17, the member 19, and the separator 21 are arranged along an outer surface of the roller 12.

The roller 13 has an internal heater lamp 22, which corresponds to the second heater lamp of the Claims. With an axis thereof parallel to the axial direction of the roller 11, the roller 13 is supported rotatably in a direction of arrow as shown in the figure. The roller 13 is pressed against the surface of the roller 11 at a predetermined pressure, for heating the surface of the roller 11. The roller 13 has a metal core 13A and a surface layer 13B. As an example, the core 13A is formed of iron of 0.15 mm to 0.3 mm thickness or aluminum of 0.25 mm to 1.0 mm thickness.

The thermistors 16 and 17 detect respective surface temperatures of the rollers 11 and 12, and output the detection results to a control section 50. According to the detected surface temperatures of the rollers 11 and 12, the section 50 controls on and off of the heater lamps 14A, 14B, 15, and 22 to maintain the respective surface temperatures constant.

The section 50 controls on and off of the heater lamps 14A, 14B, 15, and 22 for the duration of time that an image forming process is being performed (i.e., the duration between receipt of an image forming request through a not-shown operating section or the like from an user and output of an image-formed sheet to a not-shown sheet output tray) and during standby time that an image forming process is not being performed.

The sheet separators 20 and 21 serve to separate a sheet from the respective surfaces of the rollers 11 and 12. When pre-fixation toner on a sheet becomes fused by heat of the surface of the roller 11 and the sheet is pressed against the roller 11 by the roller 12, the sheet tends to be attached to the rollers 11 and 12. The separators 20 and 21 facilitate separation of a sheet from the rollers 11 and 12, respectively, thereby preventing the sheet from remaining attached to the rollers 11 and 12 and avoiding sheet jam.

The cleaning members 18 and 19 remove adhesion toner and paper dust from the respective surfaces of the rollers 11 and 12. Thus, the members 18 and 19 prevent image degradation caused by adhesion toner on the respective surfaces of the rollers 11 and 12 being deposited on a new sheet being transported into the device 1. The member 18 is supported by a support 18A formed on an inner surface of a heat roller cover 25. The member 19 is supported by a support 19A formed on an inner surface of a pressure roller cover 26.

After a toner image is transferred from the photoreceptor drum to a sheet, the sheet is transported in a direction of arrow X as shown in FIG. 1 and passed through the contact area 30. Thus, the toner image is fixed to the sheet. After being passed through the area 30, the sheet is output to the sheet output tray or the like.

The device 1 is detachably installed in the image forming apparatus. In the installed position, the device 1 is covered with the heat roller cover 25 and the pressure roller cover 26. The cover 25 covers part of each axial end surface of the roller 11, and a portion of the outer surface of the roller 11 that extends along the entire axial length, so that the heat does not escape into the air. Thus, the cover 25 prevents a drop in surface temperature of the roller 11.

The cover 25 is supported rotatably in a direction of arrow Y about an axis 25A. The cover 25 is rotated to an open position to expose a top portion of the roller 11.

Meanwhile, the cover 25 supports the external heat roller 13, the thermistor 16, and the cleaning member 18 in such a manner that, with the cover 25 in a closed position to cover the roller 1, the roller 13, the thermistor 16, and the member 18 are in contact with the surface of the roller 11. When the cover 25 is rotated, the roller 13, the thermistor 16, and the member 18 are moved together with the cover 25 along the direction of arrow Y.

The cover 26 covers part of each axial end surface of the roller 12, and a portion of the outer surface of the roller 12 that extends along the entire axial length, so that the heat does not escape into the air. Thus, the cover 26 prevents a drop in surface temperature of the roller 12, thereby also preventing a drop in surface temperature of the roller 11 due to conduction of heat from the roller 11 to the roller 12.

It is to be noted that each of the covers 25 and 26 is formed of heat-insulating material.

Figure 2:
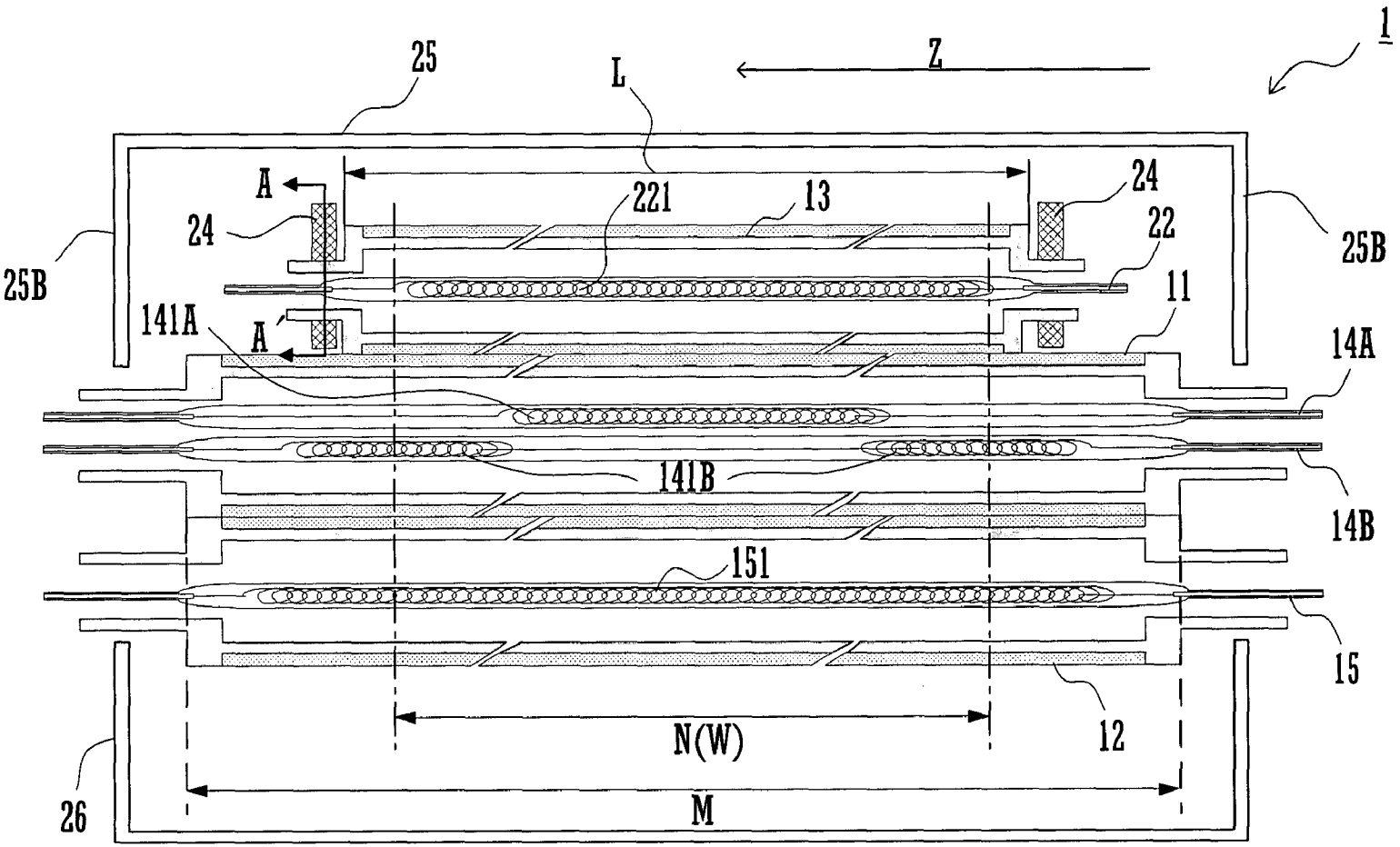
FIG. 2 is a side cross-sectional view illustrating a schematic configuration of the fusing device.

FIG. 2 is a side cross-sectional view illustrating a schematic configuration of the fusing device 1. The rollers 11 to 13 are arranged with their respective axes parallel to a direction of arrow Z. As shown in FIG. 2, the rollers 11 and 12 have equal axial length M, whereas the roller 13 has axial length L, which is shorter than the length M.

In the closed position, the cover 25 covers the roller 11 with side walls 25B facing the axial end surfaces of the roller 11.

Figure 3:
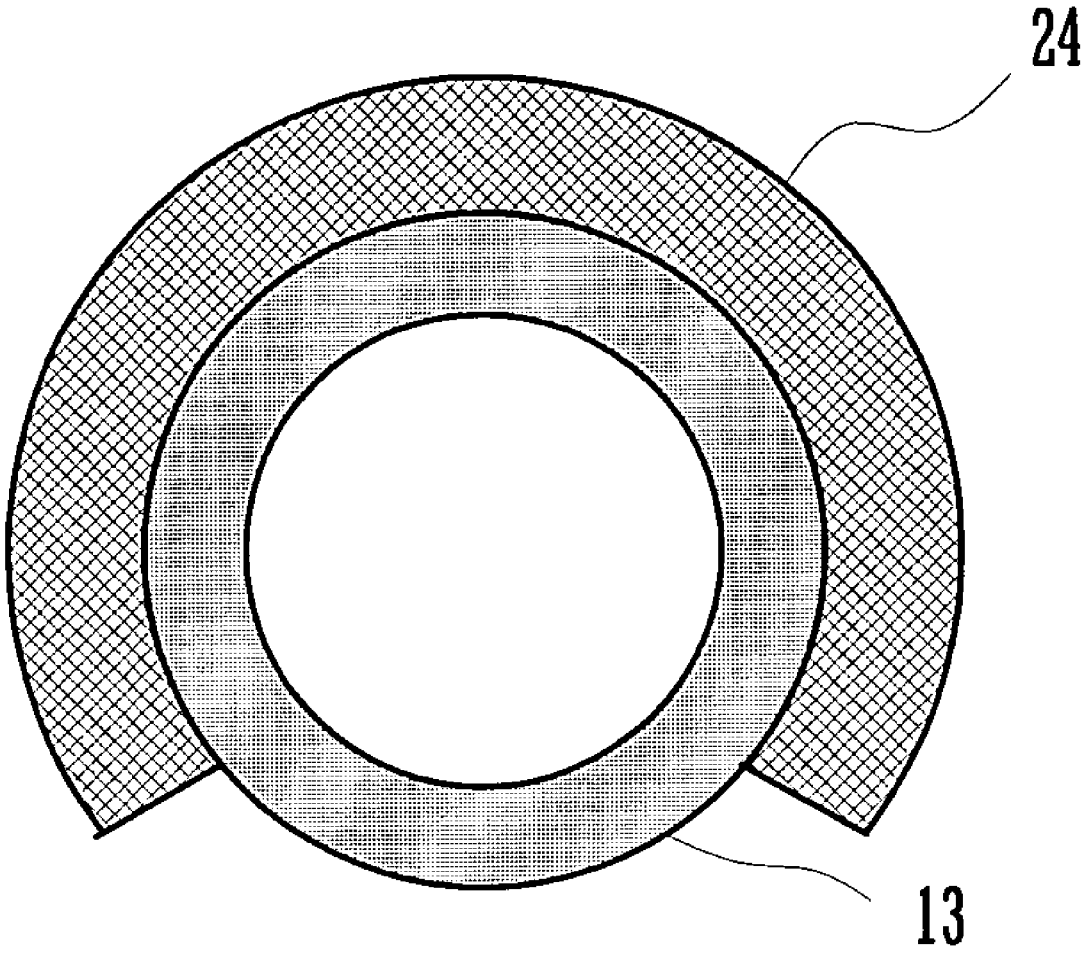
FIG. 3 is a cross sectional view along an arrow A-A' shown in FIG. 2.

The roller 13 is rotatably mounted on bearings 24. FIG. 3 is a cross sectional view along an arrow A-A' shown in FIG. 2. As shown in the figure, each of the bearings 24 has a cross section of horseshoe shape with an aperture facing the roller 11. The bearings 24 are secured to the cover 25. The bearings 24 are sliding bearings formed of resinous material, such as plastic, that includes lubricating oil. The sliding bearings as the bearings 24 prevent upsizing of the fusing device 1. Using ball bearings (rolling bearings) as the bearings 24 would require the roller 13 to have a larger diameter for avoiding physical contact between the bearings 24 and the roller 11, since rolling bearings are larger in size than sliding bearings.

Alternatively, the bearings 24 may be of metal or any other suitable material, and may be secured to a frame of the image forming apparatus, instead of to the cover 25. The rollers 11 and 12 are rotatably mounted to the frame of the apparatus.

The heater lamp 22 is shorter than each of the heater lamps 14A and 14B. The lamp 22 has a heating element 221 formed to extend almost along entire inner length of the roller 13 along the direction of arrow Z. Length of the element 221 along the direction of arrow Z is approximately equal to length N, along the direction of arrow Z, of maximum-size sheet (A3-size sheet in the present embodiment) to be passed through the contact area 30. An area of the roller 13 that faces the element 221 is heated, so that the roller 13 applies heat only to a predetermined area W of the surface of the roller 11.

The lamp 14A has a heating element 141A formed at a central portion thereof along the direction of arrow Z. The lamp 14B has a heating element 141B formed at each end thereof along the direction of arrow Z. When both of the lamps 14A and 14B are energized, the entire roller 11 is heated. When only the lamp 14A is energized, meanwhile, only the central portion of the roller 11 is heated. The heater lamp 15 has a heating element 151 formed to extend almost along entire inner length thereof along the direction of arrow Z. The lamp 15 uniformly heats the entire roller 12.

The control section 50 turns on and off the lamps 14A, 15, and 22, according to detection results from the thermistors 16 and 17, in a case where a B5-size sheet is transported for image formation with its length parallel to the direction of arrow X shown in FIG. 1. Meanwhile, the control section 50 turns on and off the lamps 14A, 14B, 15, and 22, according to detection results from the thermistors 16 and 17, in a case where a A3-size sheet is transported for image formation with its length parallel to the direction of arrow X shown in FIG. 1. In addition, the control section 50 turns on and off the lamps 14A, 14B, 15, and 22, according to detection results from the thermistors 16 and 17, during standby time.

Figure 4A:
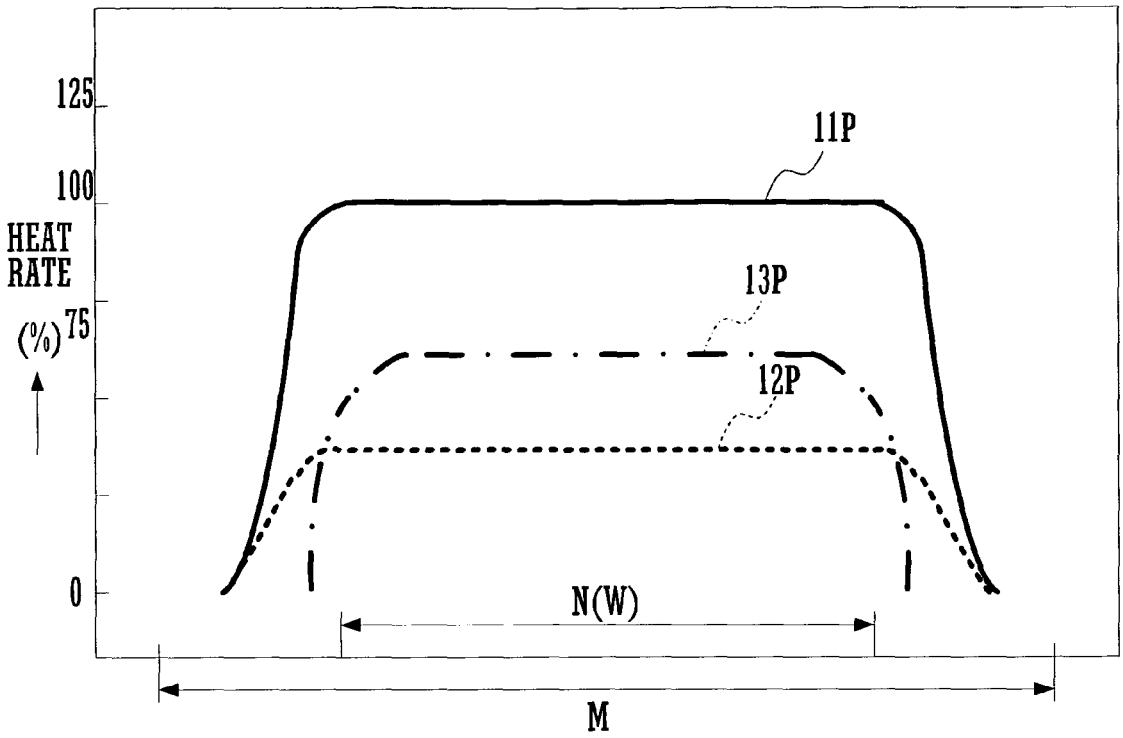
FIG. 4A is a diagram illustrating axial heat distribution of heat sources of a heat roller, a pressure roller, and an external heat roller, with no sheet being passed between the heat and pressure rollers.
Figure 4B:
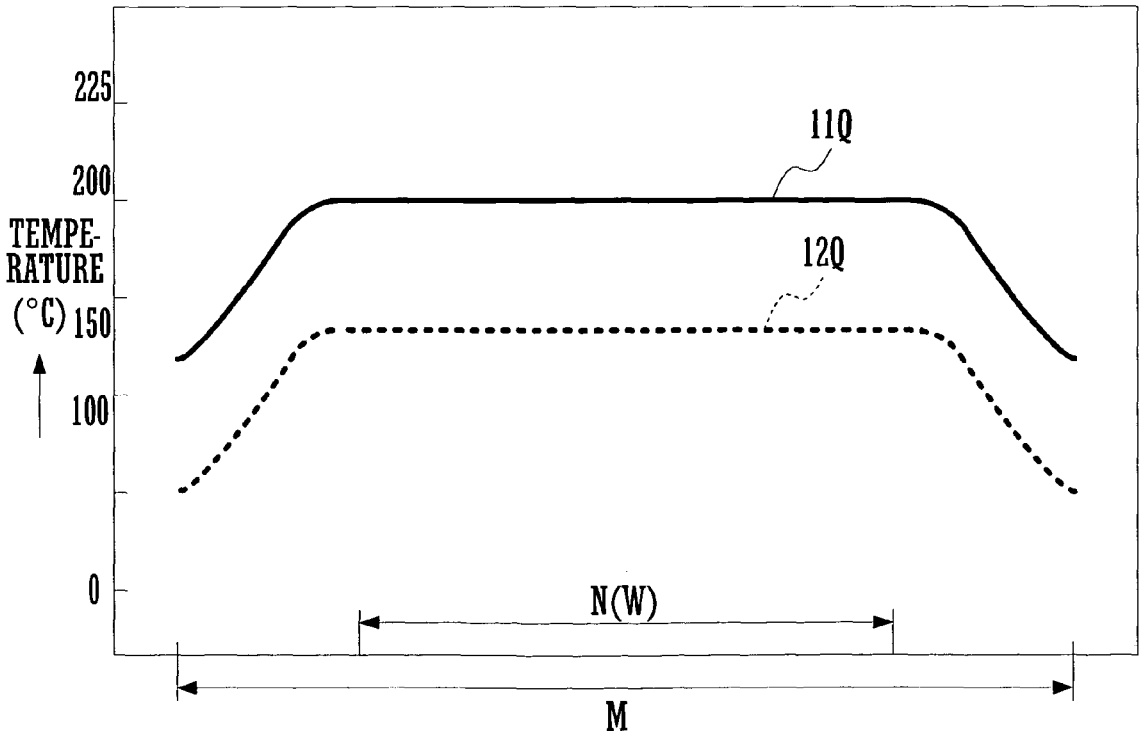
FIG. 4B is a diagram illustrating axial distribution of surface temperatures of the heat and pressure rollers in the heat distribution shown in FIG. 4A.

FIG. 4A is a diagram illustrating heat distributions of the heater lamps 14A, 14B, 15, and 22 of the rollers 11 to 13 along the direction of arrow Z, under the condition that no sheet is being passed between the rollers 11 and 12. FIG. 4B is a diagram illustrating distribution of surface temperatures of the rollers 11 and 12 along the direction of arrow Z in the heat distribution shown in FIG. 4A. FIG. 4A shows respective heat distributions 11P, 12P, and 13P of the rollers 11, 12, and 13, using heat rate of the roller 11, with only the lamps 14A and 14B as its heat sources, as the reference level (100%). FIG. 4B shows respective surface temperature distributions 11Q and 12Q of the rollers 11 and 12 detected by the thermistors 16 and 17.

As shown in FIG. 4A, each of the heat distributions 11P, 12P, and 13P is uniform within a range where the respective heating elements 141A, 141B, 151, and 221 of the lamps 14A, 14B, 15, and 22 are arranged. This allows the roller 11 to have a uniform surface temperature at least in an area including the area W, as shown in FIG. 4B.

When the roller 11 is heated from the inside, the roller 11 shows low thermal responsiveness. This is because the roller 11 has a relatively thick wall and therefore a higher heat capacity than the lamps 14A and 14B. In contrast, the roller 13 has a thin wall and therefore a low heat capacity. As soon as the roller 13 is heated by the lamp 22, the roller 13 rises in surface temperature, thereby applying heat to the area W of the roller 11 that is in contact with the roller 13.

Thus, there is no need for each of the lamps 14A and 14B to generate varying amounts of heat along the axial direction of the roller 11. A uniform surface temperature of the area W is provided by merely causing each of the lamps 14A, 14B, 15, and 22 to generate a uniform amount of heat along the axial direction. This enables a more simplified control of surface temperature of the area W than in conventional fusing devices.

The axial length M of the roller 11 is generally longer than lengths of sheets along the direction of arrow Z. However, the roller 13 heats only the predetermined area W of the surface of the roller 11 through which sheets are to be passed, thereby allowing quick heating of only the area that needs to be heated.

FIGS. 4A and 4B show a situation where both of the lamps 14A and 14B are on. Even when only the lamp 14A is on, however, it is possible for the roller 11 to have a uniform surface temperature at least in an area with which a sheet is to be brought into contact when being passed through the contact area 30.

In the present embodiment, the length of the heating element 221 is set equal to the length of the area W. Alternatively, the length L of the roller 13 may be made equal to the length of the area W.

In the present embodiment, the roller 11 has the two internal heater lamps 14A and 14B. However, the number of internal heater lamps is not limited to two, but may be one, three or more, or any number that allows the roller 11 to have a uniform axial heat distribution.

The technology being thus described, it will be obvious that the same may be varied in many ways. Such variations are not to be regarded as a departure from the spirit and scope of the technology, and all such modifications as would be obvious to one skilled in the art are intended to be included within the scope of the following claims.

What is claimed is:

1. A fusing device comprising:

a pressure member;

a heating member, positioned with an outer surface thereof in contact with an outer surface of the pressure member, for heating a sheet that is being passed in a first direction through a contact area between the pressure member and the heating member; and an external heating member for heating a predetermined area of the surface of the heating member from outside, wherein:

the predetermined area along a second direction that is perpendicular to the first direction is equal to a maximum-size sheet to be passed through the contact area in length along the second direction, the heating member is a cylindrical heat roller having first and second internal heater lamps positioned along a direction of an axis thereof, the first and second internal heater lamps respectively heating first and second areas, the first area being a central section of the heat roller, the second area being only opposite ends of the heat roller, the pressure member is a cylindrical pressure roller with an axis parallel to the axial direction of the heat roller, and the external heating member is shorter than each of the heat member and the pressure member in length along the second direction, the external heating member being a cylindrical external heat roller with an axis parallel to the axial direction of the heat roller, the external heat roller being positioned with an outer surface thereof in contact with the predetermined area, the external heat roller including an internal heater lamp positioned along an axial direction thereof, the internal heater lamp having a heating element.

2. The fusing device according to claim 1, wherein the internal heater lamp of the external heat roller heats a portion of the surface of the external heat roller facing the predetermined area, approximately uniformly along the axial direction of the external heat roller.

3. The fusing device according to claim 2, wherein:

the pressure roller has an internal heater lamp positioned along the axial direction thereof, the first and second internal heater lamps of the heat roller heat at least a portion of the surface of the heat roller that is to be brought into contact with a sheet being passed through the contact area, approximately uniformly along the axial direction of the heat roller, and the internal heater lamp of the pressure roller heats at least a portion of the surface of the pressure roller that is to be brought into contact with a sheet being passed through the contact area, approximately uniformly along the axial direction of the pressure roller.

4. An image forming apparatus comprising:

an image bearing member for bearing a developer image; and the fusing device of claim 3, the fusing device fixing a developer image transferred from the image bearing member to a sheet.

5. An image forming apparatus comprising:

an image bearing member for bearing a developer image; and the fusing device of claim 2, the fusing device fixing a developer image transferred from the image bearing member to a sheet.

6. The fusing device according to claim 1, wherein the external heat roller is rotatably mounted on bearings each having a cross section of horseshoe shape with an aperture facing the heat roller.

7. An image forming apparatus comprising:

an image bearing member for bearing a developer image; and the fusing device of claim 6, the fusing device fixing a developer image transferred from the image bearing member to a sheet.

8. An image forming apparatus comprising:

an image bearing member for bearing a developer image; and the fusing device of claim 1, the fusing device fixing a developer image transferred from the image bearing member to a sheet.

* * * * *